US005495714A

United States Patent [19]

Gros et al.

[11] Patent Number: 5,495,714

[45] Date of Patent: Mar. 5, 1996

[54] CONDENSER ENVELOPE MADE OF CONCRETE FOR A STRUCTURALLY INDEPENDENT LOW PRESSURE MODULE

[75] Inventors: Jean-Pierre Gros, Villemomble; Gérard Foucher, Tremblay en France, both of France

[73] Assignee: GEC Alsthom Electromecanique SA, Paris, France

[21] Appl. No.: 441,010

[22] Filed: May 15, 1995

Related U.S. Application Data

[63] Continuation of Ser. No. 138,104, Oct. 20, 1993, abandoned.

[30] Foreign Application Priority Data

Oct. 21, 1992 [FR] France ..... 92 12580

[51] Int. Cl.[6] ..... F01K 11/02

[52] U.S. Cl. ..... 60/687; 60/694; 165/82; 165/83; 165/67; 165/69; 165/102

[58] Field of Search ..... 60/687, 694, 685; 165/82, 83, 69, 67, 102

[56] References Cited

U.S. PATENT DOCUMENTS

| | | | |
|---|---|---|---|
| 1,831,454 | 11/1931 | Kirgan | 165/83 |
| 1,891,607 | 12/1932 | Rainey | 165/67 |
| 3,312,447 | 4/1967 | Bellati et al. | 60/687 |
| 3,447,320 | 6/1969 | Hitchcock et al. | 60/687 |
| 3,494,414 | 2/1970 | Warner | 165/82 |
| 3,968,834 | 7/1976 | Mangus et al. | 165/82 |
| 4,189,927 | 2/1980 | Gray | 60/687 |
| 4,257,233 | 3/1981 | Kaelber | 60/687 |
| 4,311,016 | 1/1982 | Kaelber | 60/687 |
| 4,484,447 | 11/1984 | Gueraud | 60/687 |
| 5,094,588 | 3/1992 | Gros | 415/213.1 |
| 5,106,264 | 4/1992 | Gros | 415/213.1 |
| 5,108,258 | 4/1992 | Gros | 415/213.1 |

FOREIGN PATENT DOCUMENTS

| | | |
|---|---|---|
| 2120492 | 8/1972 | France . |
| 0415314 | 3/1991 | France . |
| 121510 | 12/1918 | United Kingdom . |
| 1015052 | 12/1965 | United Kingdom . |

*Primary Examiner*—Ira S. Lazarus
*Assistant Examiner*—L. Heyman
*Attorney, Agent, or Firm*—Sughrue, Mion, Zinn, Macpeak & Seas

[57] ABSTRACT

A structure comprising an LP module of a steam turbine supported by a concrete support-block carried by posts standing on a concrete raft, and an enclosure constituted by an exhaust box surrounding the LP module and connected thereto via elastic seals and by a condenser provided with bundles disposed beneath the LP module and resting on the raft, wherein the enclosure is made of concrete. The condenser envelope made of concrete is thus totally independent of the turbine and of its support-block.

6 Claims, 5 Drawing Sheets

PRIOR ART

PRIOR ART

CONDENSER ENVELOPE MADE OF CONCRETE FOR A STRUCTURALLY INDEPENDENT LOW PRESSURE MODULE

This is a continuation of application No. 08/138,104 filed Oct. 20, 1993.

The steam turbines used for generating electricity are generally condensing turbines, and the steam which leaves the exhaust box of the low pressure (LP) modules is directed to a condenser situated beneath the turbine.

BACKGROUND OF THE INVENTION

The exhaust box 1 of the LP module 2 and the envelope 3 of the condenser form a vast vacuum enclosure 4 that is made of sheet metal and that is reinforced by internal ties (see FIGS. 1 and 2).

The exhaust box 1 and the envelope 3 have their own specific functions:

The exhaust box 1 and the support-block 5 on which it rests support the active portion of the turbine, i.e. the rotor 6 and the LP body 7. It is the permanent or variable deformations of this assembly that govern the maintenance of radial clearances between the rotor and the LP body, and thus the proper dynamic behavior of the shaft line. The exhaust box 1 directs the steam towards the heat-exchange bundles 8 of the condenser 3.

The condenser envelope 3 stands on the raft 9 and only has to support the static load internal to the condenser 3, and in particular the condensation bundles 8.

The exhaust box 1 and the condenser envelope 3 are connected together to form said single vacuum enclosure 4.

If the connection 12 is rigid (e.g. by welding) then the enclosure 4 withstands force due to outside pressure, but it exerts varying forces on the support legs 10 of the exhaust box 1 and also on the raft (see FIG. 1); these varying forces are due to the varying mass of water contained in the condenser and to thermal expansion of the condenser. Thus, when the condenser cools, the load on the springs 11 diminishes while the load on the support legs increases.

If the connection 12 is elastic (FIG. 2) then the two enclosures are "mechanically" separate and forces due to outside pressure together with the weight of the LP module are supported by the support-block 5 through the support legs 10 of the exhaust box. The total mass of the condenser envelope 3 together with the forces due to the vacuum are supported by the foundation raft 9 without interposed springs 11.

Neither of the above two configurations is satisfactory since there is always interference and incompatibility between the turbine/support-block function and the condensation function.

All projects for making the condenser envelope out of concrete have been based on the above two principles that are practically unavoidable when the condenser is situated beneath the low pressure turbine. Thus, the block supporting the turbine and the concrete condenser envelope are intimately linked since the infrastructure of one is used for making the other.

In such a structure, there is therefore interference between the turbine/support-block function and the condensation function.

The drawbacks described above applicable to the use of a steel condenser envelope are thus still present, and in addition there are the displacements of the support-block and condenser structure due to the varying internal temperatures in the condenser which are detrimental to proper operation of the turbine.

OBJECT AND SUMMARY OF THE INVENTION

In order to make a condenser out of concrete without the above drawbacks, the inventors have had the idea of modifying the steam turbine and exhaust box assembly of the kind in which the exhaust box surrounds the LP body in sealed manner by virtue of flexible seals.

The present invention provides a structure comprising an LP module of a steam turbine supported by a concrete support-block carried by posts standing on a concrete raft, and an enclosure constituted by an exhaust box surrounding the LP module and connected thereto via elastic seals and by a condenser provided with bundles disposed beneath the LP module and resting on the raft, wherein the enclosure is made of concrete.

The concrete condenser envelope is thus totally independent of the turbine and of its support-block.

This implementation presents the following advantages:

a very rigid envelope structure standing on the raft;

the structure can stand on anti-seismic shock absorbers;

reduced vibration;

reduced noise;

elimination of internal reinforcement that is a detriment to flow; and reduction in the time required for constructing the condenser envelope which is made at the same time as the civil engineering works.

BRIEF DESCRIPTION OF THE DRAWINGS

The present invention will be better understood in the light of the following description, given with reference to the accompanying drawings in which.

MORE DETAILED DESCRIPTION

When the condenser is situated beneath the low pressure turbine, the GEC Alsthom technique of an LP structure having an independent envelope constitutes an ideal basis for making a single enclosure out of concrete, which enclosure includes both the condenser envelope and a portion that serves as the steam box, but causes no mechanical or thermal interference with the low pressure turbine.

Figure 1:
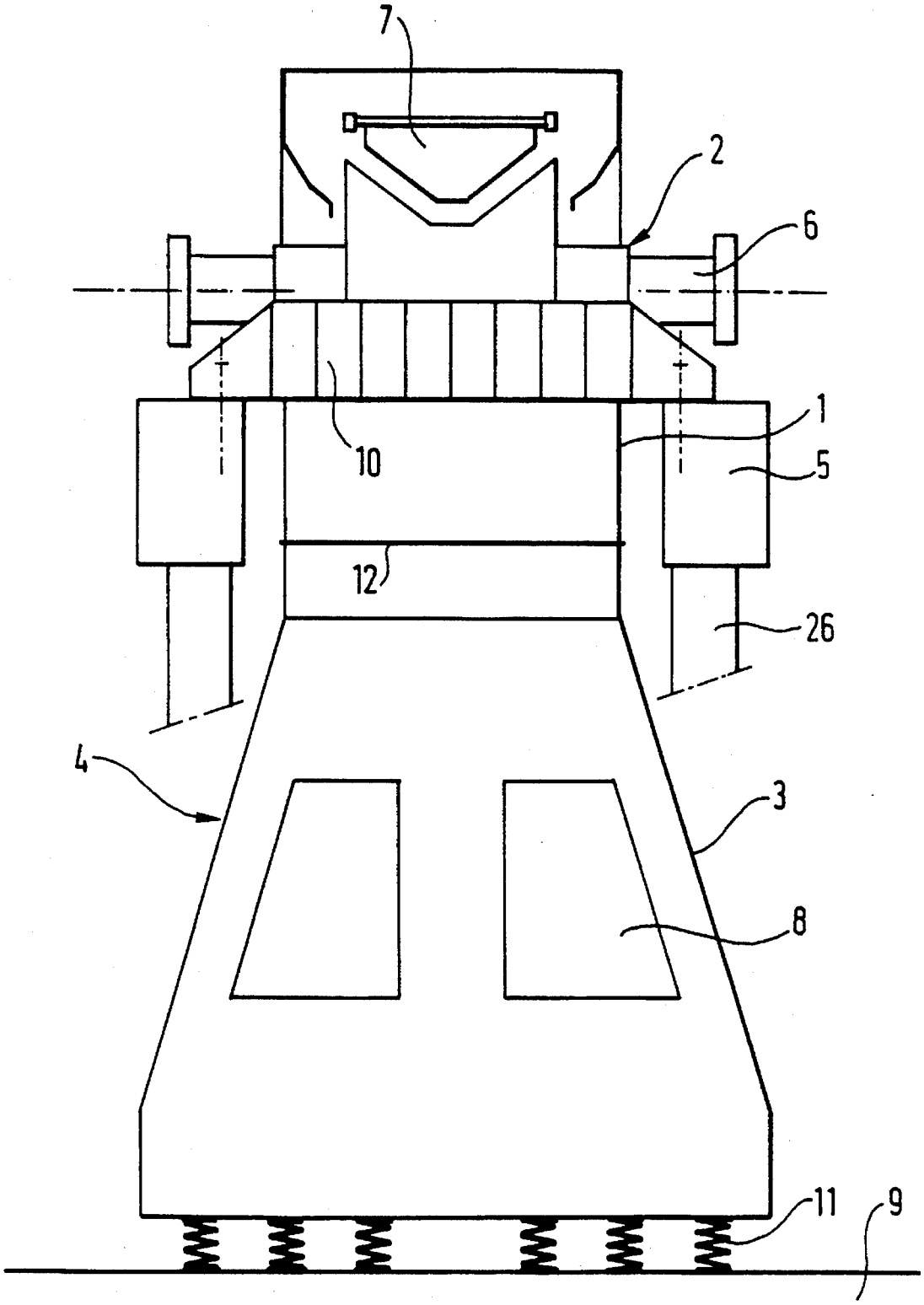
FIGS. 1 and 2 show known structures.
Figure 2:
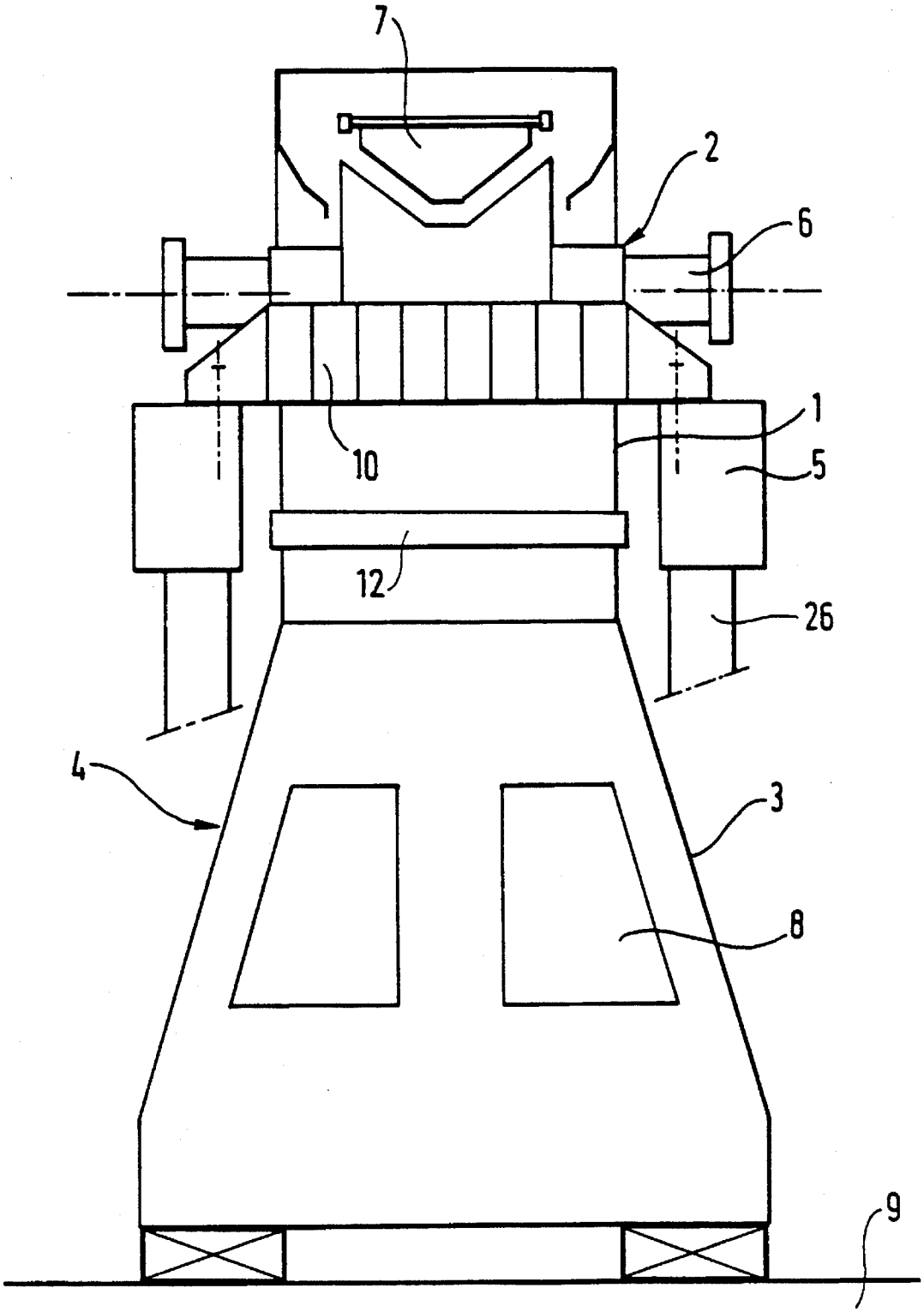

Under such circumstances, the exhaust box serves only to direct steam to the condenser. It supports neither the LP body, nor the rotor, as in the cases shown in FIGS. 1 and 2.

The turbine function is thus completely separated from the function of collecting steam and condensing it.

Figure 4:
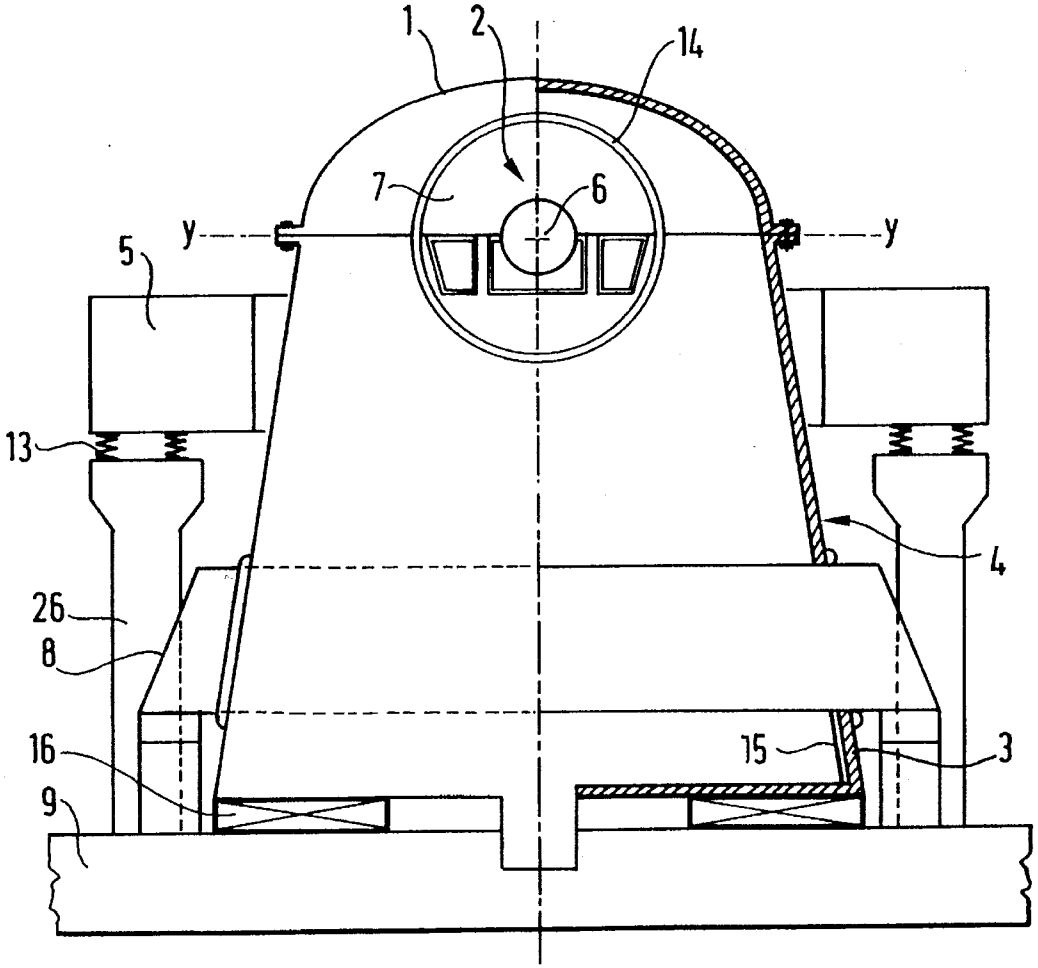
FIGS. 3 and 4 are a side view and a front view of a structure of the invention.
Figure 3:
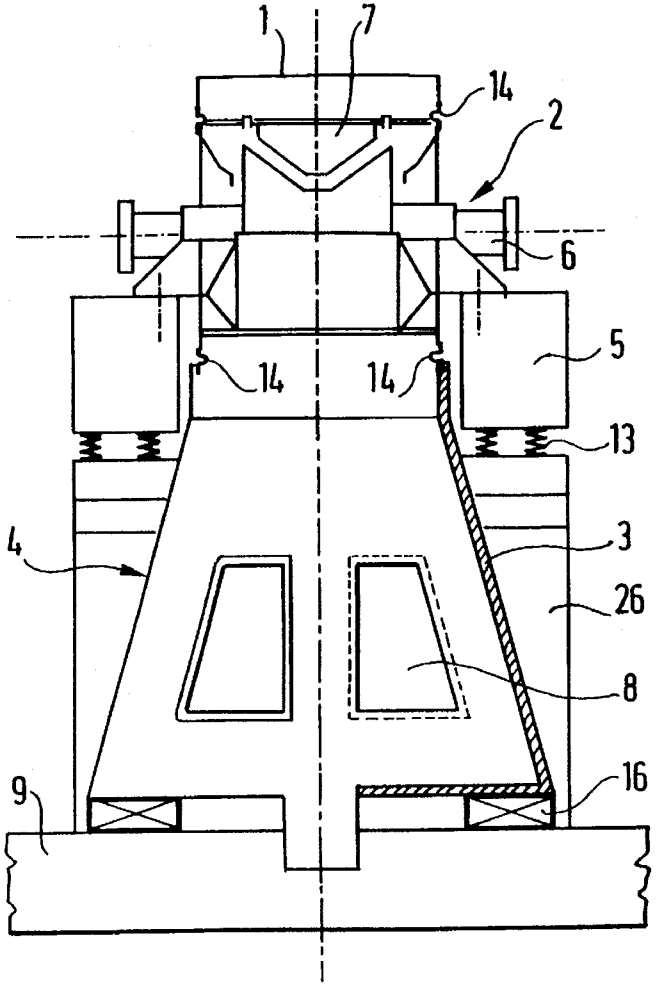

The LP module 2 includes the LP body 7 which supports the LP rotor 6. It rests on the support-block 5 (see FIGS. 3 and 4).

The support-block 5 itself rests on posts 26 via springs 13. Alternatively, it may be rigidly connected to the posts 26. The posts 26 are integrated with the raft 9.

The LP body 7 passes through the enclosure 4, the exhaust box 1, and the condenser envelope 3, and circular elastic seals 14 provide sealing relative to the outside.

The support-block 5 supports only the mass of the LP module 2 of the turbine, and there are no other external forces.

The condensation function is performed by the single enclosure 4 made of concrete and provided with an inside skin 15 of thin steel sheet providing sealing for the distilled water.

The enclosure 4 comprises:

the exhaust box 1; and the condenser envelope 3.

The new single envelope made of concrete is constructed in two portions that meet in the horizontal join plane of the turbine as shown by YY so that access to the turbine can be obtained by removing the top portion of the envelope. Sealing is ensured by bolting and welding a tongue of steel or else by installing a mortar joint.

This single enclosure 4 stands on the raft 9. It may be:

integral with the raft 9; or supported by the raft 9 via shock absorbers 16 interposed to improve the resistance of the structure to accelerations due to earthquakes and to facilitate thermal displacements of the enclosure 4.

The forces due to vacuum or to small positive pressure are directly taken up by the concrete structure of the single enclosure 4.

Vertical displacements relative to the raft 9 due to temperature changes can take place without applying force to the low pressure module 2 of the turbine because of the circular elastic seals 14 that provide sealing between the turbine and the enclosure 4.

It may be observed that the loads on the support-block 5 are kept strictly to the mass of the LP module 2, thereby making it possible to keep the height of the support-block small, thus leaving large side openings that facilitate installing the bundles 8 in the condenser 3.

Figure 5:
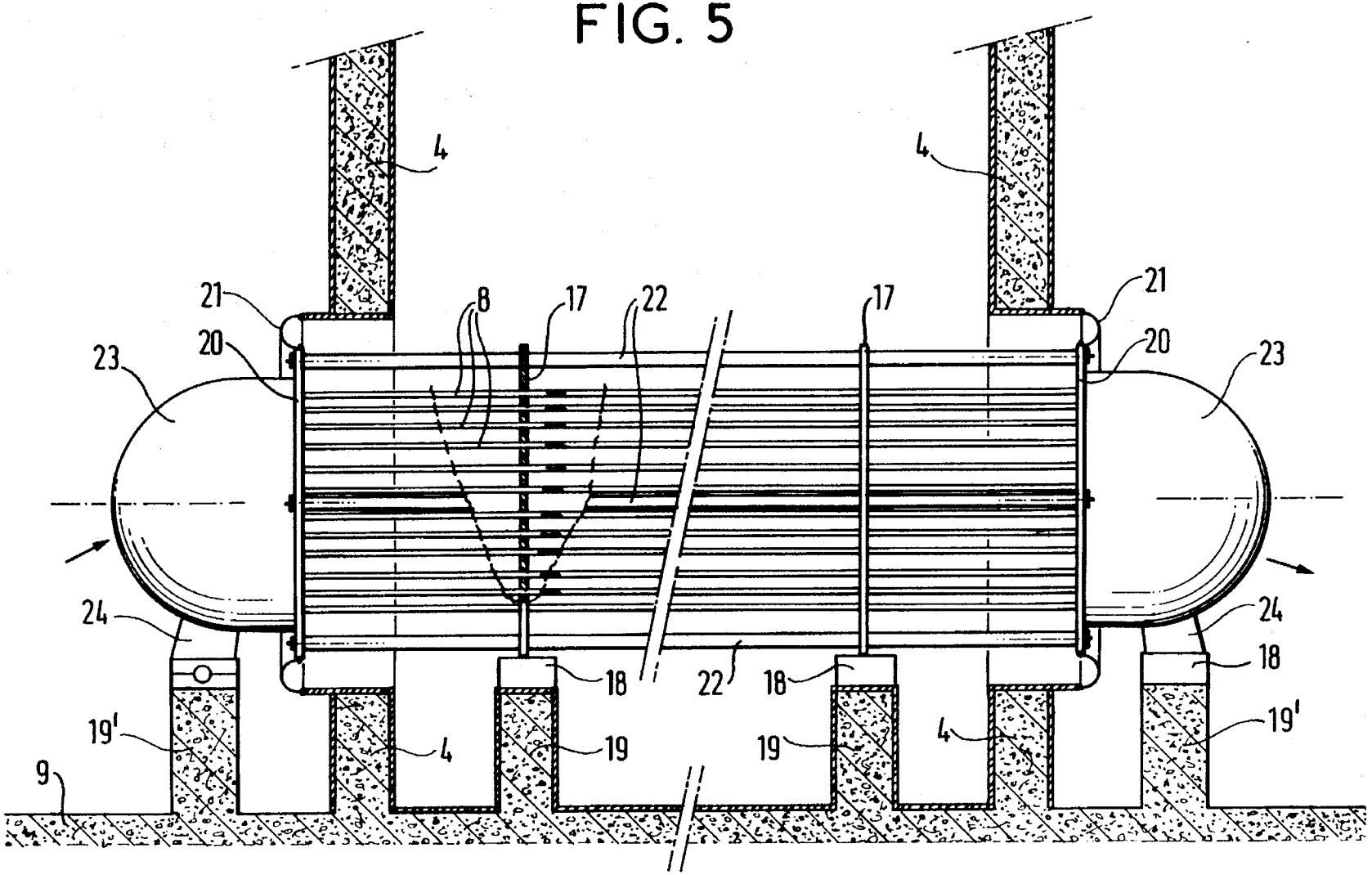
FIG. 5 shows one way of mounting the condenser bundles.

The installation of the bundles 8 is totally independent of the enclosure 4 thus facilitating maintenance, and in particular facilitating total replacement of the bundles (see FIG. 5).

The bundles 8 are mounted so as to be free to expand through perforated plates 17. These plates 17 are supported via resilient pads 18 standing on internal concrete stands 19 disposed inside the enclosure 4.

The ends of the bundles 8 are mounted so as to be free to expand through two end plates 20. The plates 20 are provided with respective peripheral elastic seals 21 of U-shaped section that provide sealing relative to the enclosure 4.

The plates 17 and 20 are interconnected by horizontal ties 22.

A water tank 23 provided with tabs 24 is fitted to each of the end plates 21. The tabs 24 of one of the tanks 23 are fixed and supported by external concrete stands 19' standing on the raft 9.

The tabs 24 on the other water tank stand on external concrete stands 19' via resilient pads 18 enabling the bundles 8 to expand.

Figure 6:
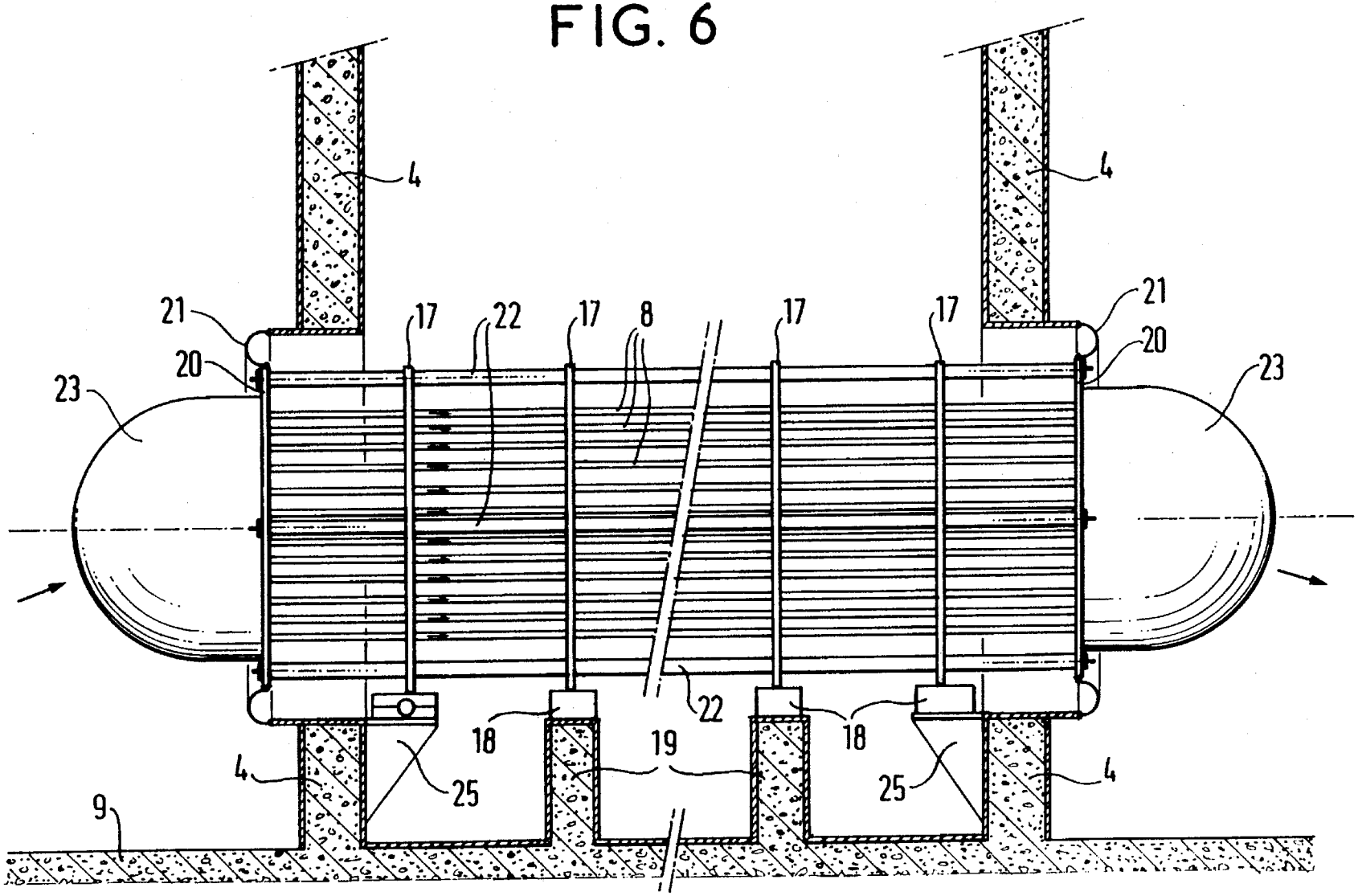
FIG. 6 shows a variant of FIG. 5.

As shown in FIG. 6, in a variant of FIG. 5 there are no external stands, but the plates 17 adjacent to the plates 20 are carried by steel support brackets 25 fixed to the inside envelope of the enclosure 4 (see FIG. 6). One of the support brackets 25 is provided with a resilient pad 18, while the other serves as a fixed point.

We claim:

1. A structure comprising an LP module of a steam turbine supported by a concrete support-block carried by posts standing on a concrete raft, and a vacuum enclosure made of concrete, including an exhaust box surrounding the LP module and a condenser envelope provided with bundles disposed beneath the LP module, said exhaust box being connected to the LP module by means of first elastic seals and said condenser envelope being connected to said bundles by means of second elastic seals.

2. A structure according to claim 1, wherein the vacuum enclosure includes a thin internal sealing skin made of steel.

3. A structure according to claim 1, wherein said condenser envelope is connected to said bundles by means of second elastic seals, and wherein the bundles are mounted with freedom to expand through vertical plates that are connected together by ties, said vertical plates including end plates secured to respective water tanks and being connected via said second elastic seals to the vacuum enclosure, and at least some of said vertical plates being carried by concrete stands inside the vacuum enclosure and supported by the raft.

4. A structure according to claim 3, wherein the plates adjacent to the end plates are carried by steel brackets fixed to the inside wall of the enclosure.

5. A structure according to claim 3, wherein the water tanks are provided with tabs carried by concrete stands outside the enclosure.

6. A structure according to claim 3, wherein the stands other than one of the stands closest to one of the two water tanks are provided with resilient pads.

* * * * *